US007309088B2

(12) United States Patent
Fiore et al.

(10) Patent No.: US 7,309,088 B2
(45) Date of Patent: Dec. 18, 2007

(54) COLLAPSIBLE POOL SKIMMER COVER/BASKET RETRIEVAL DEVICE

(76) Inventors: Sharon Fiore, 61 Highland Meadow Dr., North Attleboro, MA (US) 02760; Alex Fiore, 61 Highland Meadow Dr., North Attleboro, MA (US) 02760

( * ) Notice: Subject to any disclaimer, the term of this patent is extended or adjusted under 35 U.S.C. 154(b) by 0 days.

(21) Appl. No.: 11/418,670

(22) Filed: May 5, 2006

(65) Prior Publication Data

US 2007/0108784 A1 May 17, 2007

Related U.S. Application Data

(60) Provisional application No. 60/681,766, filed on May 18, 2005.

(51) Int. Cl.
*B25J 1/04* (2006.01)

(52) U.S. Cl. ..... 294/24; 294/26

(58) Field of Classification Search ..... 294/2, 294/19.1, 24, 26; 7/109, 167
See application file for complete search history.

(56) References Cited

U.S. PATENT DOCUMENTS

| | | | | | |
|---|---|---|---|---|---|
| 705,775 | A * | 7/1902 | Moore | 294/19.1 |
| 1,791,518 | A * | 2/1931 | Woodring | 294/26 |
| 4,447,927 | A * | 5/1984 | Malless, Jr. | 15/236.04 |
| 5,137,623 | A * | 8/1992 | Wall et al. | 210/238 |
| 5,170,681 | A * | 12/1992 | Kemp | 81/176.15 |
| 5,553,905 | A * | 9/1996 | Bentivegna | 294/24 |
| 5,876,080 | A * | 3/1999 | Grippo | 294/26 |
| 6,422,623 | B1 * | 7/2002 | Thomas | 294/24 |
| 6,652,013 | B1 * | 11/2003 | Peterson | 294/19.1 |

* cited by examiner

*Primary Examiner*—Dean J Kramer

(57) ABSTRACT

A dual purpose tool for both removing the cover plate of a pool skimmer then removing the basket therein to avoid the dangers of human contact with the contents of the skimmer basket. The tool consists of a substantially stiff elongate member with dual purpose hooks located at opposite ends. One hook is designed for removing the skimmer cover through insertion into the skimmer cover hole located at its center while the opposite end is designed to hook around the skimmer basket handle for removal of the basket. The tool can be configured in multiple lengths to accommodate skimmers for above and in-ground pools.

16 Claims, 3 Drawing Sheets

COLLAPSIBLE POOL SKIMMER COVER/BASKET RETRIEVAL DEVICE

CROSS-REFERENCE TO RELATED APPLICATIONS

This application claims the benefit of U.S. Provisional Application 60/681,766 filed May 18, 2005.

FIELD OF THE INVENTION

The present invention relates to a dual-purpose tool for accessing a pool skimmer basket to prevent contact with live insects therein.

BACKGROUND OF THE INVENTION

In the routine maintenance of an above or in-ground pool it is required that the skimmer basket be removed and emptied on a daily basis. The pool skimmer basket is a central repository for debris that collects on the pool water surface during pool operation. Quite often live insects including hornets, spiders, and the like are trapped in the skimmer prior to the skimmer basket being removed for cleaning. The conventional way of removing the skimmer basket would be to pop the cover with ones hand then remove the basket with the other hand. This approach leaves the hand exposed in close proximity to a quickly escaping insect and thus increases the chances of being bitten.

SUMMARY OF THE INVENTION

The foregoing and other problems are overcome, and other advantages are realized, in accordance with the disclosed, alternative embodiments of these teachings.

The present invention relates to a dual-purpose tool for both removing the cover plate of a skimmer basket then removing the basket therein. The tool consists of a substantially stiff elongate member with duel purpose hooks located at opposite ends. One hook is designed for removing the skimmer cover through insertion into the skimmer cover hole located at its center while the opposite end is designed to hook around the skimmer basket handle for removal of the basket. The tool can be configured in two lengths to accommodate skimmers for above and in-ground pools.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

While certain embodiments of the present invention have been illustrated and described herein, the present invention should not be limited to such illustrations and descriptions. It should be apparent to those skilled in the art that changes and modifications may be incorporated and embodied as part of the present invention and are within the scope of the claims.

Figure 1:
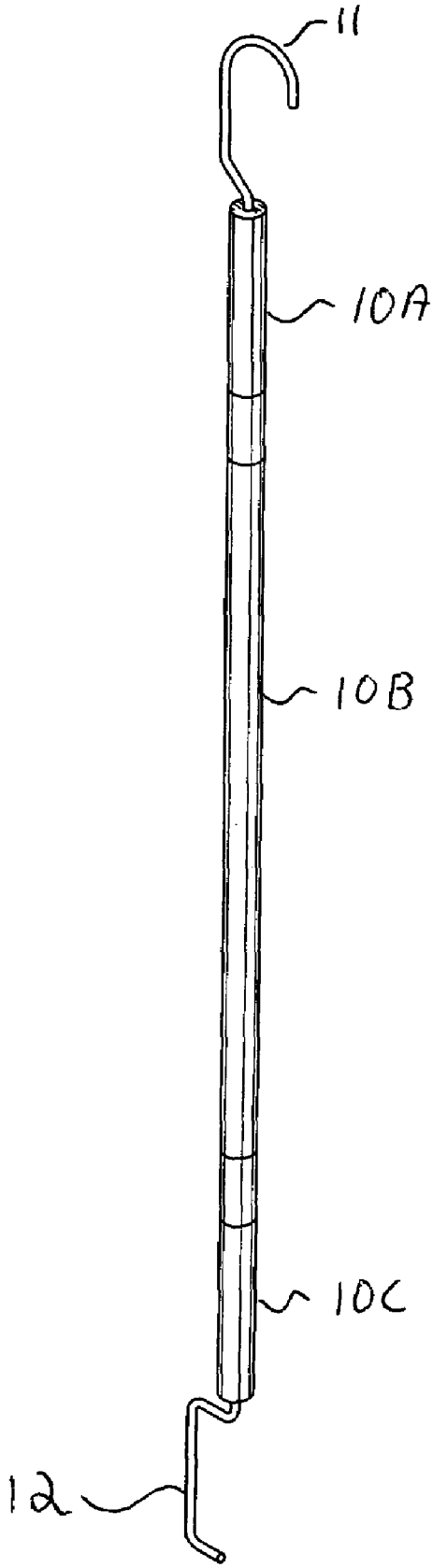
FIG. 1 illustrates an embodiment of subject invention.
Figure 2:
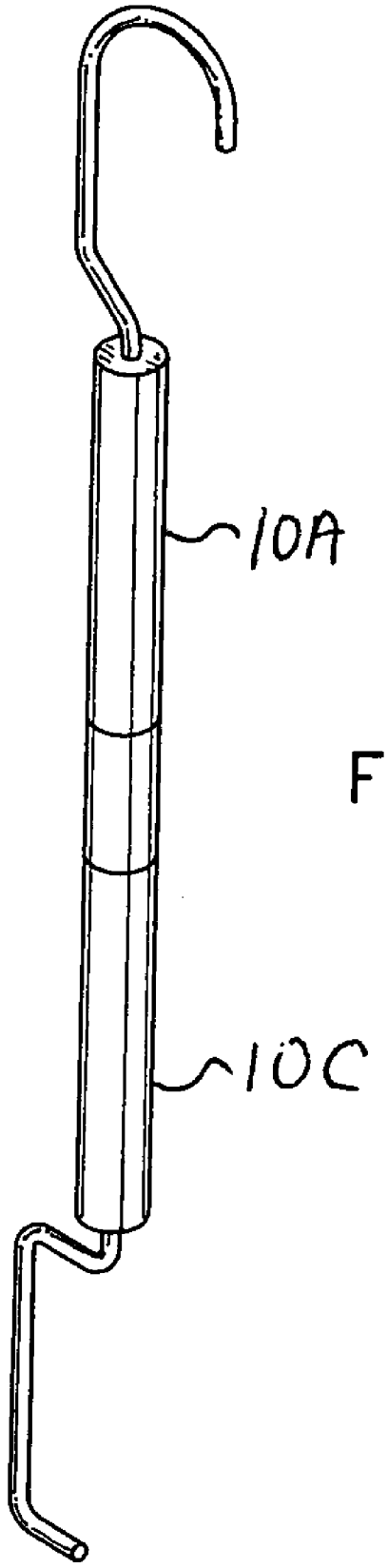
FIG. 2 illustrates an alternate embodiment of subject invention.
Figure 3:
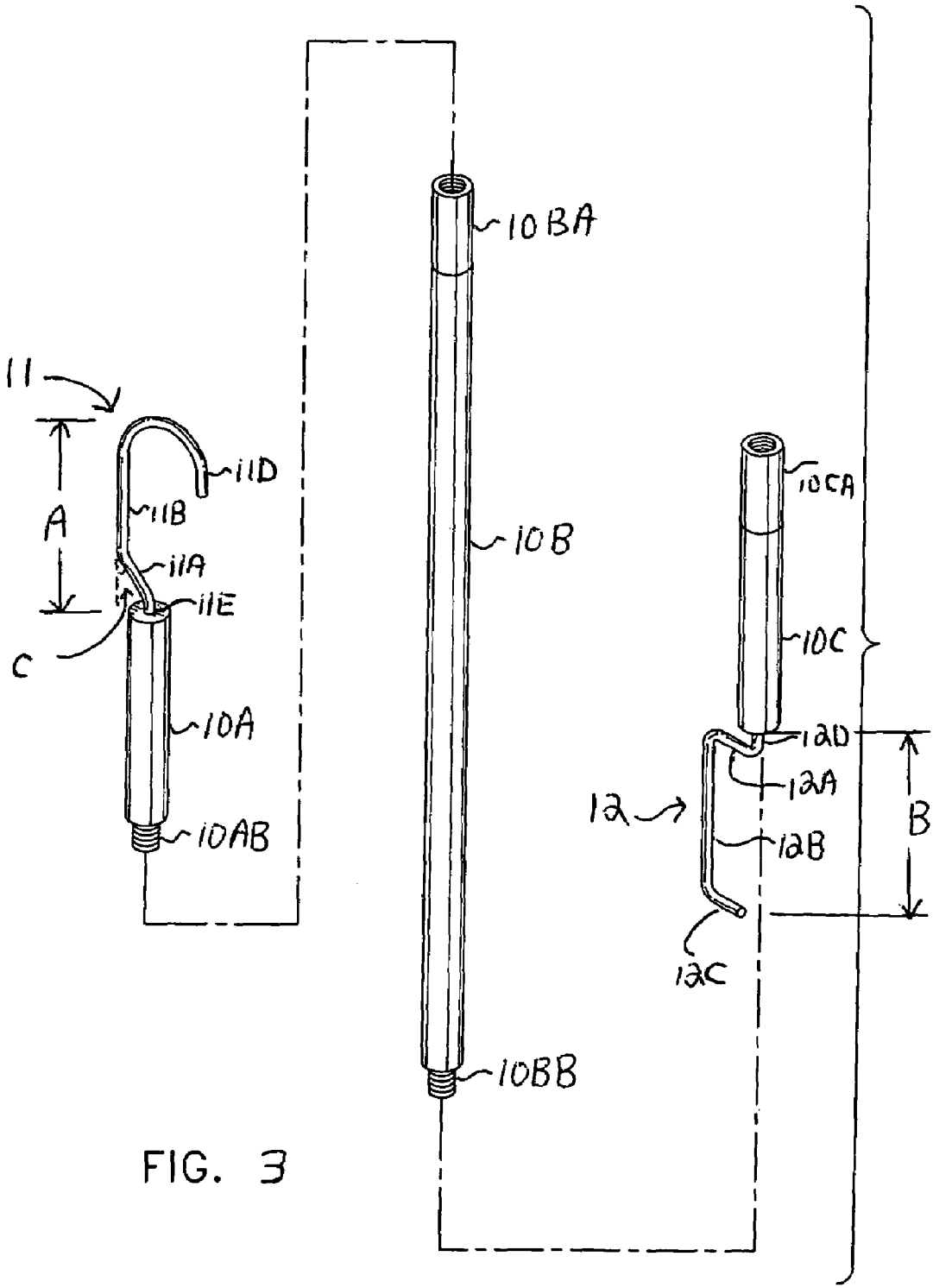
FIG. 3 illustrates an exploded view of the embodiment of FIG. 1.

Referring to the drawings (FIGS. 1-3) of the invention in detail, FIG. 1 illustrates one embodiment of the present invention. FIG. 2 illustrates a shorter alternative embodiment of subject invention. In application one end of the tool is used to remove a skimmer cover then the other end of the tool is used to remove the skimmer basket. The hook on one end of the tool is elongate with a short extension to facilitate entry into a skimmer cover hole for removal. The cover is then removed from the hook then the other end of the tool is used to hook the skimmer basket handle for removal and cleaning thereof. The two-step method allows for a safe separation of the user from the contents of the skimmer basket. The tool comprises a stiff elongate section that can be separated to reduce the elongate section length for different applications. The tool is provided in kit form and can be assembled into a short or long length depending on the application. Referring to FIG. 3, the sections can be separated into segments 10A, 10B, and 10C. Section 10A comprises a first hook 11 and threaded male end 10AB. Extender section 10B comprises a threaded female end 10BA which threadedly engages end 10AB. Section 10B further includes a threaded male end 10BB. Section 10C includes a threaded female end 10CA which threadedly engages male end 10BB. Section 10C further includes a second hook end 12. For a shorter tool, sections 10A and 10C can be combined via threadedly engaging sections 10AB and 10CA, as illustrated in FIG. 2. For a longer tool sections 10A, 10B and 10C can be threadedly engaged as described above, and illustrated in FIG. 1.

The first hook section 11 comprises an arcuate section 11D, to facilitate hooking and grabbing a skimmer basket handle. The arcuate section 11D may extend up to 180 degrees. A shank 11B, which is linear, extends tangentially from arcuate section 11D. An offset section, 11A, which is offset from shank section 11B towards the opening of the arcuate section 11D by an acute angle 11C extends from the shank and includes a substantially linear end section 11E that mates to section 10A. In the preferred embodiment end section 11E thrededly engages shaft 10A. The second hook section 12 comprises an elongate section 12B having a short linear outward extension 12C at its end, to facilitate hooking and grabbing a skimmer cover through the covers center hole. A second short linear outward extension 12A, extends from the opposite end of elongate section 12B. Section 12A further includes a linear extension 12D at its end that mates to section 10C. In the preferred embodiment end section 12D thrededly engages shaft 10C. In the preferred embodiment, sections 12A, 12B, 12C and 12D are at right angles to each other.

It is understood that the size of the sections 10A, 10B, and 10C may vary according to the particular application. In the preferred embodiment section 10B is about 14 inches, section 10A is about 10 inches, and section 10C is about 10 inches. In the preferred embodiment, first hook section 11 length A is approximately 4.5 inches and second hook section 12 length B is approximately 6 inches. It is understood that any variations are within the scope of the present invention.

What is claimed is:

1. A collapsible skimmer basket retrieval device comprising:

a first stiff elongate section, said first section comprising a first hook at one end, and a first engagement means at the opposite end;

a second stiff elongate section, said second section comprising a second engagement means at one end and a third engagement means at the opposite end;

a third stiff elongate section, said third section comprising a fourth engagement means at one end and a second hook at the opposite end, wherein said second hook comprises a second hook elongate section, said second hook elongate section further comprising a first short extension extending outward at one end of said second hook elongate section and a second short extension extending outward at the opposite end of said second hook elongate section, said first short extension for engaging a skimmer basket cover, said second short extension further including a third short extension extending outward therefrom, said extension engaging said third stiff elongate section;

said first engagement means coupled to said second engagement means, and said third engagement means coupled to said fourth engagement means, said first, second, and third elongate sections being rigidly connected.

2. The retrieval device of claim 1 wherein said first hook comprises an arcuate section, a linear shank portion extending tangentially from said arcuate section, and an offset section, said offset section extending outward from said shank and engaging said first stiff elongate section.

3. The retrieval device of claim 1, wherein said first short extension and said second short extension extend outward at a ninety degree angle.

4. The retrieval device of claim 1 wherein said first, said second, said third and said fourth engagement means further comprise male and female threaded engagement members.

5. The retrieval device of claim 1 wherein said first and said third engagement means are threaded male ends and said second and said fourth engagement means are threaded female ends.

6. The retrieval device of claim 1, wherein said first section is about 10 inches, said second section is about 14 inches, and said third section is about 10 inches.

7. A collapsible skimmer basket retrieval device comprising:

a first stiff elongate section, said first section comprising a first hook at one end, and a first engagement means at the opposite end;

a third stiff elongate section, said third section comprising a fourth engagement means at one end and a second hook at the opposite end, wherein said second hook comprises a second hook elongate section, said second hook elongate section further comprising a first short extension extending outward at one end of said second hook elongate section and a second short extension extending outward at the opposite end of said second hook elongate section, said first short extension for engaging a skimmer basket cover, said second short extension further including a third short extension extending outward therefrom, said extension engaging said third stiff elongate section;

said first engagement means coupled to said fourth engagement means to form a shorter length tool, said first and said third elongate sections being rigidly connected.

8. The retrieval device of claim 7, wherein said first hook comprises an arcuate section, a linear shank portion extending tangentially from said arcuate section, and an offset section, said offset section extending outward from said shank and engaging said first stiff elongate section.

9. The retrieval device of claim 7, wherein said first short extension and said second short extension extend outward at a ninety degree angle.

10. The retrieval device of claim 7, wherein said first and said fourth engagement means further comprise male and female threaded engagement members.

11. The retrieval device of claim 7, wherein said first engagement means is a threaded male end and said fourth engagement means is a threaded female end.

12. A collapsible skimmer basket retrieval device kit comprising:

a first stiff elongate section, said first section comprising a first hook at one end, and a first engagement means at the opposite end;

a second stiff elongate section, said second section comprising a second engagement means at one end and a third engagement means at the opposite end;

a third stiff elongate section, said third section comprising a fourth engagement means at one end and a second hook at the opposite end, wherein said second hook comprises a second hook elongate section, said second hook elongate section further comprising a first short extension extending outward at one end of said second hook elongate section and a second short extension extending outward at the opposite end of said second hook elongate section, said first short extension for engaging a skimmer basket cover, said second short extension further including a third short extension extending outward therefrom, said extension engaging said third stiff elongate section;

said first, second and third stiff elongate sections being interchangeable to form various length devices.

13. The retrieval device kit of claim 12 wherein said first hook comprises an arcuate section, a linear shank portion extending tangentially from said arcuate section, and an offset section, said offset section extending outward from said shank and engaging said first stiff elongate section.

14. The retrieval device kit of claim 12, wherein said first short extension and said second short extension extend outward at a ninety-degree angle.

15. The retrieval device kit of claim 12 wherein said first, said second, said third and said fourth engagement means further comprise male and female threaded engagement members.

16. The retrieval device kit of claim 12 wherein said first and said third engagement means are threaded male ends and said second and said fourth engagement means are threaded female ends.

* * * * *